US011391095B2

(12) United States Patent
Tian et al.

(10) Patent No.: US 11,391,095 B2
(45) Date of Patent: Jul. 19, 2022

(54) POLYCRYSTALLINE DIAMOND COMPACT AND DRILLING BIT

(71) Applicant: KINGDREAM PUBLIC LIMITED COMPANY, Hubei (CN)

(72) Inventors: Hongping Tian, Hubei (CN); Qiang Liu, Hubei (CN); Guanfu Tu, Hubei (CN); Xiaobo Liu, Hubei (CN)

(73) Assignee: KINGDREAM PUBLIC LIMITED COMPANY, Hubei (CN)

( * ) Notice: Subject to any disclaimer, the term of this patent is extended or adjusted under 35 U.S.C. 154(b) by 0 days.

(21) Appl. No.: 16/957,928

(22) PCT Filed: Dec. 25, 2018

(86) PCT No.: PCT/CN2018/123340

§ 371 (c)(1),
(2) Date: Jun. 25, 2020

(87) PCT Pub. No.: WO2019/128956

PCT Pub. Date: Jul. 4, 2019

(65) Prior Publication Data

US 2020/0347680 A1 Nov. 5, 2020

(30) Foreign Application Priority Data

Dec. 26, 2017 (CN) ..... 201721848205.0

(51) Int. Cl.
*E21B 10/567* (2006.01)

(52) U.S. Cl.
CPC ..... *E21B 10/5673* (2013.01)

(58) Field of Classification Search
CPC ..... E21B 10/5673; B23C 3/16
See application file for complete search history.

(56) References Cited

U.S. PATENT DOCUMENTS 7,588,102 B2 * 9/2009 Hall ..... E21B 10/5673 175/425
7,726,420 B2 * 6/2010 Shen ..... E21B 10/5673 175/430

(Continued)

FOREIGN PATENT DOCUMENTS

CN 101592021 A 12/2009
CN 101748974 A 6/2010

(Continued)

*Primary Examiner* — Carib A Oquendo
(74) *Attorney, Agent, or Firm* — Kilpatrick Townsend & Stockton LLP

(57) ABSTRACT

The disclosure relates to a polycrystalline diamond compact including a cemented carbide substrate and a diamond layer, with the diamond layer disposed at the top face of cemented carbide substrate, there are at least two continuous varying cambered convex ridges at the end face of the diamond layer, each cambered convex ridge extending from the edge of the end face to the center of end face, with the width of each continuous varying cambered convex ridge increasing gradually from the edge of the end face to the center of the end face. Both ploughing effect and the fracture drilling property of the PDC cutting face with each continuous varying cambered convex ridge are improved, the cutting resistance during drilling is reduced and thus the rate of penetration of the PDC bit is increased. A drilling bit with the polycrystalline diamond compact disposed at the end thereof is provided in the disclosure.

15 Claims, 8 Drawing Sheets

(56) References Cited

U.S. PATENT DOCUMENTS

| | | | | |
|---|---|---|---|---|
| 10,287,825 | B2 * | 5/2019 | Chen | E21B 10/5735 |
| 10,605,010 | B2 * | 3/2020 | De Maindreville | E21B 10/42 |
| 2010/0059287 | A1 * | 3/2010 | Durairajan | E21B 10/5673 175/420.2 |
| 2018/0274303 | A1 * | 9/2018 | Song | C22C 29/14 |
| 2019/0368277 | A1 * | 12/2019 | Zhao | C04B 35/528 |
| 2020/0157890 | A1 * | 5/2020 | Cuillier De Maindreville | E21B 10/5735 |

FOREIGN PATENT DOCUMENTS

| | | | | | |
|---|---|---|---|---|---|
| CN | 102296931 | A | | 12/2011 | |
| CN | 204703772 | U | | 10/2015 | |
| CN | 106089089 | A | | 11/2016 | |
| CN | 106089090 | | * | 11/2016 | E21B 10/46 |
| CN | 106089090 | A | | 11/2016 | |
| CN | 206000466 | U | | 3/2017 | |
| CN | 207728311 | U | | 8/2018 | |
| JP | 59224795 | A | | 12/1984 | |

* cited by examiner

POLYCRYSTALLINE DIAMOND COMPACT AND DRILLING BIT

RELATED APPLICATIONS

This application is a national stage of PCT/CN2018/123340 filed on Dec. 25, 2018, and is based on the application for the Chinese patent filed on Dec. 26, 2017, named as "A Polycrystalline Diamond Compact" with the application number of 201721848205.0, the application claims priority and the disclosed content of these applications hereby are incorporated by reference in its entirety.

TECHNICAL FIELD

The present disclosure relates in general to a polycrystalline diamond compact in petroleum exploration technical field.

BACKGROUND OF ART

Since the beginning of 1980's, diamond bit has been widely used in petroleum and natural gas drilling engineering. Based on the cutting element, the diamond bit comprising a bit body and cutting elements is divided into three kinds: PCD (polycrystalline diamond) bit, TSP (thermally stable polycrystalline diamond) bit and natural diamond bit. PDC bit, which is mainly used from soft to medium hard formation. With continuous development, the application of PDC (polycrystalline diamond compact) bit has become wider and wider with fairly good economic value, while TSP bit is mainly used from medium hard to ultra hard formation. Due to the deeper and deeper drilling operations in petroleum and natural gas drilling engineering at present, the encountered formation is becoming more and more complicated.

When encountering the formation with conglomerate or the formation staggered from soft to hard frequently, the polycrystalline diamond compact under fairly big impact load tends to be chipped and then gets failed, as a result, the bit would get failed, and thus, a polycrystalline diamond compact with strong impact-resistance property is needed at rig site. The impact resistance property of available polycrystalline diamond compacts is improved through interface structure between diamond layer and cemented carbide substrate in the polycrystalline diamond compact to reduce its residual stress or the change of material formula or process technology. Although PCD layers with irregular cutters such as ball head shaped and conical shaped, etc. could improve its impact resistant ability, and during drilling, the cutting resistance is big, the bit torque is large, and drilling efficiency is low.

SUMMARY OF THE INVENTION

In order to improve the deficiency of the available technologies, the present disclosure provides a polycrystalline diamond compact, including a cemented carbide substrate and a diamond layer disposed at the top face of the cemented carbide substrate, there are at least two protruding continuous varying cambered convex ridges at the end face of the diamond layer, each continuous varying cambered convex ridge extending from the edge of end face to the center of the end face, the width of each continuous varying cambered convex ridge increases gradually from the edge of the end face to the center of the end face, which is in proportion to the distance from the edge of end face.

In some embodiments, the curvature radius of each continuous varying cambered convex ridge increases gradually from the edge of the end face to the center of the end face or keeps constant.

In some embodiments, the top face of continuous varying cambered convex ridge is parallel to the bottom face of the cemented carbide substrate.

In some embodiments, both sides of continuous varying cambered convex ridge comprise two flanks tilting downwards.

In some embodiments, there are 2 to 10 continuous varying cambered convex ridges, such as 2 to 4 ridges.

In some embodiments, the curvature radius of continuous varying cambered convex ridge at the edge of the end face is from 0.5 mm to 4 mm, such as 1 mm.

In some embodiments, the curvature radius of the continuous varying cambered convex ridge at the center of the end face is from 4 mm to 12 mm, such as 6 mm.

In some embodiments, the flanks tilting downwards at both sides of the continuous varying cambered convex ridge are inclined planes, and the angle of 5 to 20 degrees between the inclined plane and the bottom flat of the cemented carbide substrate, such as 10 degrees or 15 degrees.

In some embodiments, the continuous varying cambered convex ridges are evenly distributed circumferentially on the end face.

In some embodiments, the end face edge of the diamond layer is chamfered.

In some embodiments, the diamond layer comprises polycrystalline diamond layer or thermally stable polycrystalline diamond layer.

In some embodiments, the radial cross-section of the polycrystalline diamond compact is circular or elliptical.

In some embodiments, a binding interface between cemented carbide substrate and diamond layer is flat, concave-convex or groove.

The disclosure also provides a drilling bit with above-mentioned polycrystalline diamond compact disposed at its end.

BRIEF DESCRIPTION OF THE DRAWINGS

The features and advantages of the present disclosure, which will become apparent, are attained and may be understood in more detail, more particular description of the disclosure briefly summarized may be had by reference to the embodiments thereof that are illustrated in the appended drawings which form a part of this specification. In the appended drawings.

DETAILED DESCRIPTION OF THE EMBODIMENTS

Further illustration in relation to this disclosure hereinafter would be combined with appended drawings and embodiments.

In the description of this disclosure, it should be understood that such terms as "center", "lateral", "longitudinal", "front", "back", "left", "right", "above", "below", "vertical", "horizontal", "top", "bottom", "inside" and "outside" indicating direction or position relations based on the direction or position relations shown in the appended drawings are to facilitate how to describe this disclosure and simplify the description only, instead of indicating or implying the indicated device or component should be in a specific direction or construct and operate in a specific direction, and thus, it should not be understood as the limitation to the scope protection in this disclosure.

First Embodiment

Referring from FIG. 1 to FIG. 4, the polycrystalline diamond compact comprises a diamond layer 101 and a cemented carbide substrate 102, the diamond layer 101 is disposed on the top face of the cemented carbide substrate 102, the end face of the diamond layer 101 having two continuous varying cambered convex ridges 103, 104, two continuous varying cambered convex ridges 103, 104 extend inward and intersect at the center of the end face, with the width of each continuous varying cambered convex ridges 103, 104 gradually increasing from the edge of the end face to the center of end face.

In some embodiments, the curvature radius of each continuous varying cambered convex ridges 103, 104 gradually increases or keeps constant from the edge of the end face to the center of the end face.

Figure 4:
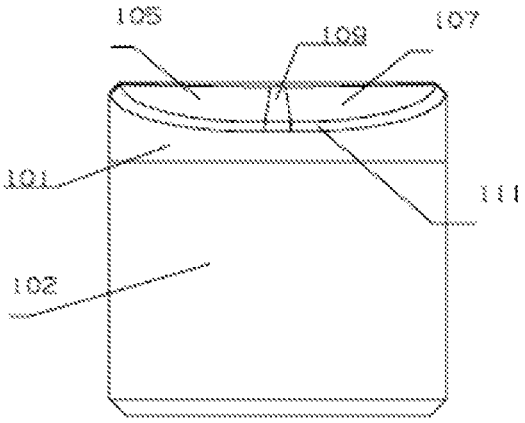
Figure 5:
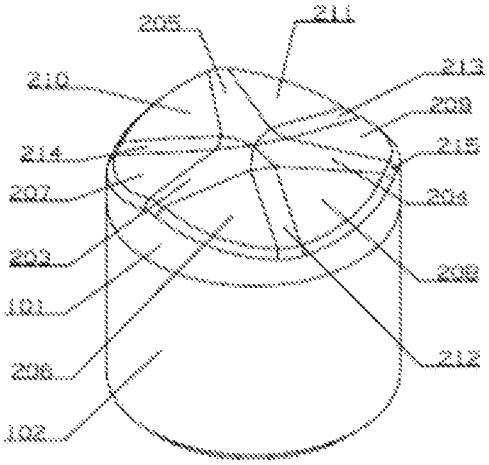
FIGS. 5 to 8 are isometric view, top view, front view and side view of a second embodiment of the disclosure respectively.
Figure 6:
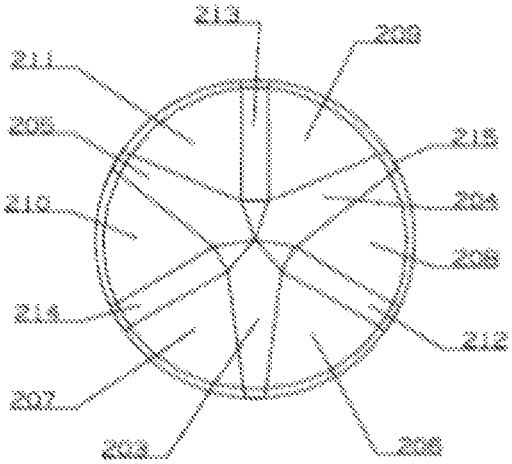
Figure 7:
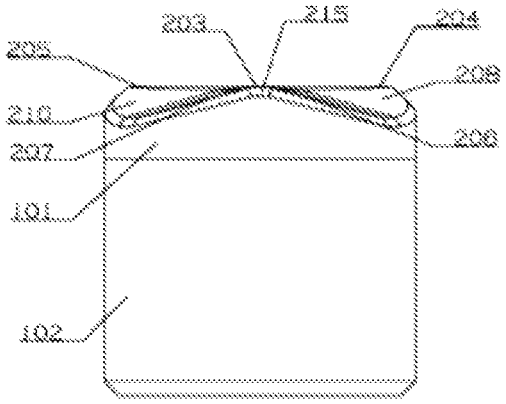
Figure 8:
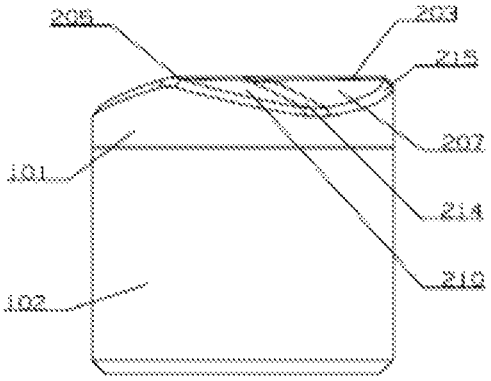
Figure 9:
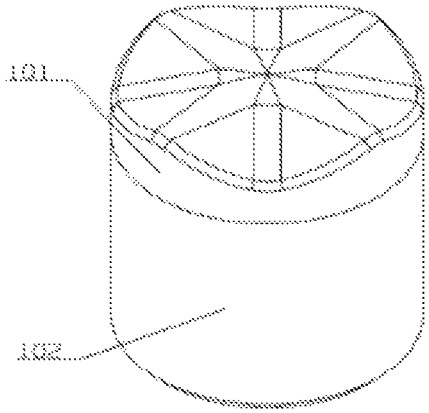
FIGS. 9 to 12 are isometric view, top view, front view and side view of a third embodiment of the disclosure respectively.
Figure 10:
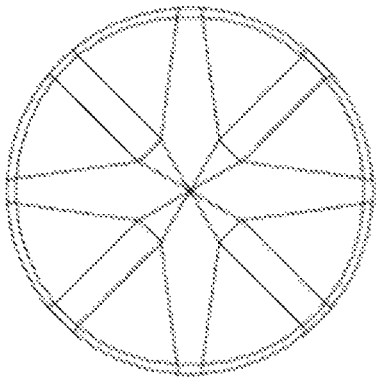
Figure 11:
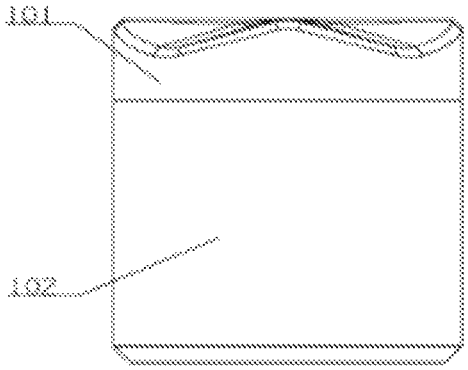
Figure 12:
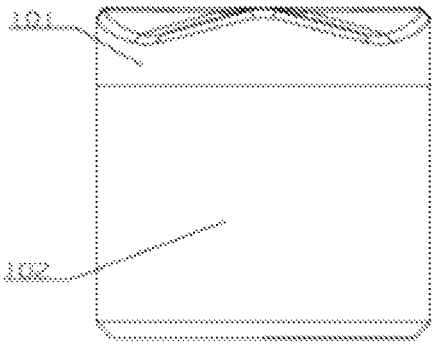
Figure 13:
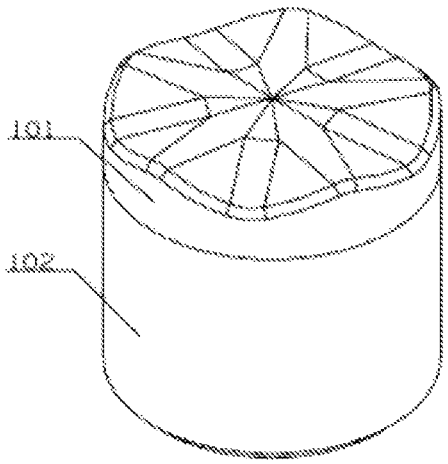
FIGS. 13 to 16 are isometric view, top view, front view and side view of a fourth embodiment of the disclosure respectively.
Figure 14:
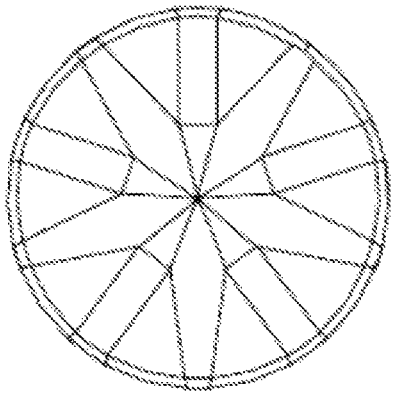
Figure 15:
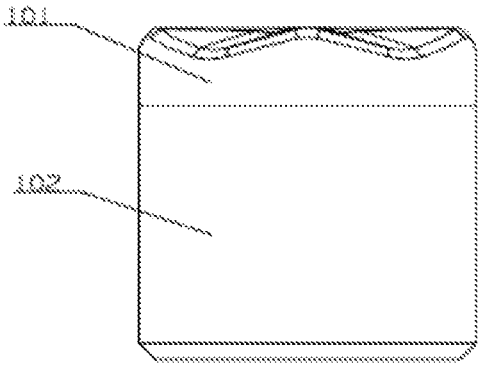
Figure 16:
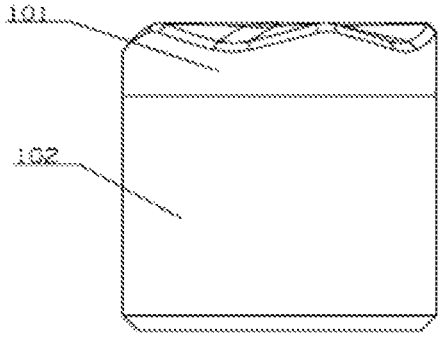
Figure 17:
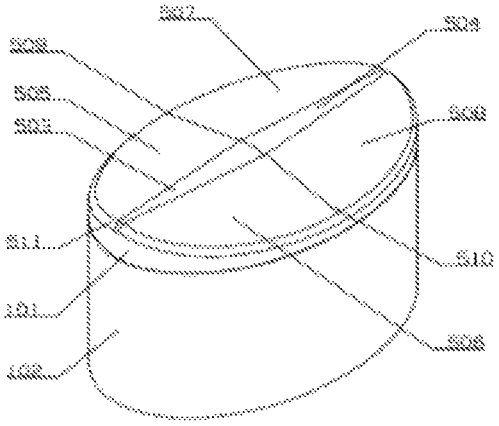
FIGS. 17 to 20 are isometric view, top view, front view and side view of a fifth embodiment of the disclosure respectively.
Figure 18:
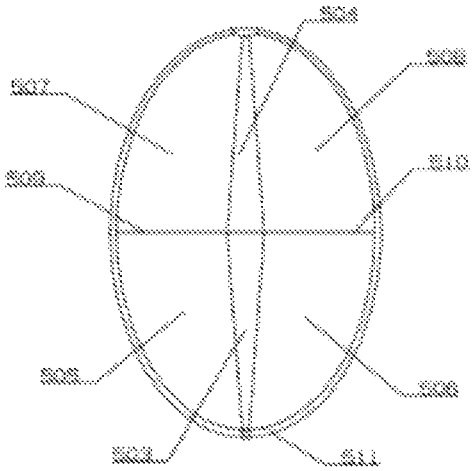
Figure 19:
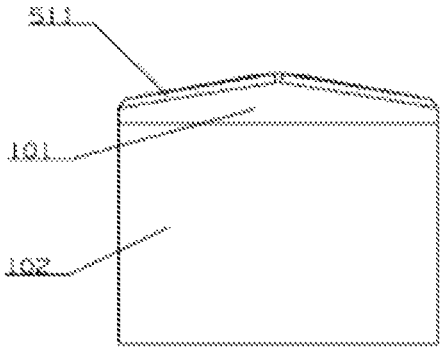
Figure 20:
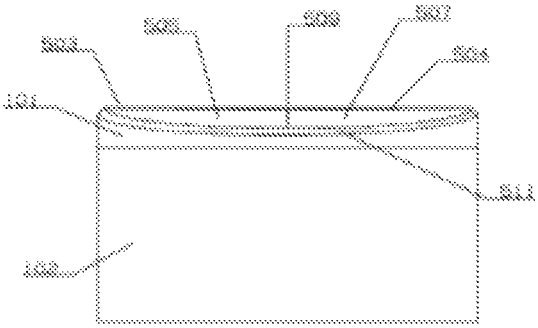

In some embodiments, the top face of each of continuous varying cambered convex ridges 103, 104 is parallel to the bottom face of cemented carbide substrate 102. As shown in FIG. 4, the height of each of continuous varying cambered convex ridges 103, 104 is constant relative to cemented carbide substrate 102, and each of continuous varying cambered convex ridges 103, 104 is horizontal.

Continuous varying cambered convex ridges could improve ploughing effect of the cutting face and fracture drilling property of the polycrystalline diamond compact, and reduce cutting resistance during drilling and thus improve the rate of penetration of a diamond bit.

Figure 1:
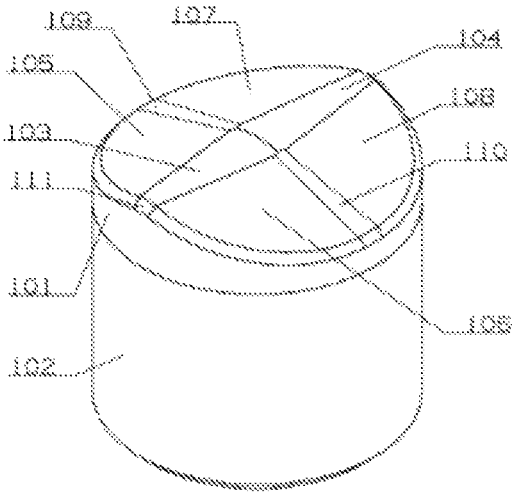
FIGS. 1 to 4 are isometric view, top view, front view and side view of a first embodiment of the disclosure respectively.
Figure 2:
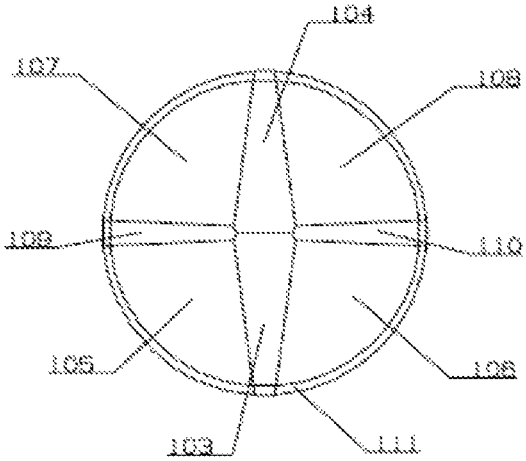
Figure 3:
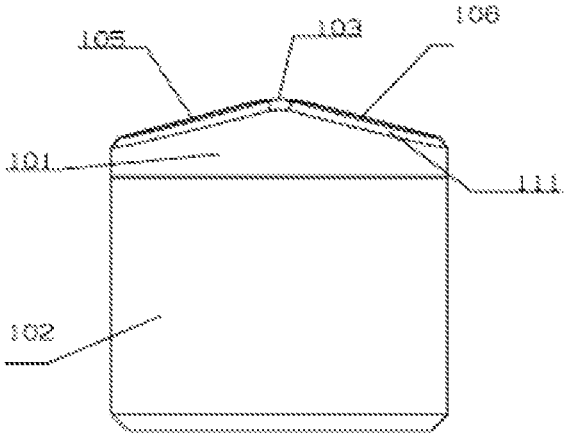

As shown in FIG. 1, two continuous varying cambered convex ridges are evenly distributed circumferentially, that is, the central angle between two adjacent continuous varying cambered convex ridges is 180°.

A half of the end face is constituted by one continuous varying cambered convex ridge 103 and two flanks 105 and 106 at both sides of the ridge 103, another half of the end face is constituted by another continuous varying cambered convex ridge 104 and two flanks 107 and 108 at both sides of the ridge 104, the two flanks at the both sides are inclined plane tilting downwards, with two flanks between two continuous varying cambered convex ridges 103 and 104 intersecting with each other to form transitional arc surfaces 109, 110. The edge 111 of diamond layer may be set to be inclinedly chamfered.

The cutting face formed by the continuous varying cambered convex ridges and flanks could improve its impact resistance property, and play a role in leading removal of debris from a bottom hole, further increase rate of penetration of a diamond bit and enhance the impact resistance ability of the polycrystalline diamond compact.

The deeper the formation goes, the hardness is gradually increasing in most cases and the cutting face of the polycrystalline diamond compact wears away gradually, and the width of an end of continuous varying cambered convex ridge adjacent to the edge of the end face would get wider due to the wear. With penetration going deeper, the cutting area at the cutting face would become wider gradually, so that at earlier stage of drilling, the polycrystalline diamond compact may improve the penetration ability while at later stage of drilling, and ensure that the polycrystalline diamond compact is of both relatively good drilling ability and impact resistance ability, therefore, it is more suitable for various formations.

Due to the multiple cutting faces of the polycrystalline diamond compact, it may be rotated to another unworn cutting face after the wear of one cutting face, and thus the performance cost of drilling bit is reduced.

Alternatively, the curvature radius of continuous varying cambered convex ridges at the edge of the end face is from 0.5 mm~4 mm, such as 1 mm.

Alternatively, the curvature radius of convex ridges at the center of the end face is from 4 mm~12 mm, such as 6 mm.

Alternatively, the included angle between flanks and the radial cross-section of cemented carbide substrate is from 5°~20°, such as 15°.

Alternatively, the transitional arc radius between flanks is 4 mm.

Alternatively, the radial cross-section of the polycrystalline diamond compact is round with diameter of 15.8 mm.

Second Embodiment

As shown from FIG. 5 to FIG. 8, there are three continuous varying cambered convex ridges 203, 204 and 205 at the end face of the diamond layer, with continuous varying cambered convex ridges extending from the edge of the end face and intersecting at the center of end face, three continuous varying cambered convex ridges are evenly distributed circumferentially, that is, the central angle between two adjacent continuous varying cambered convex ridges is 120°. Flanks 206, 207; 208, 209; 210, 211 are disposed at both sides of each of the continuous varying cambered convex ridges respectively, and each of the transitional arc surfaces 212, 213, 214 is disposed between two flanks, which are located between two adjacent continuous varying cambered convex ridges, and the edge of end face is chamfered. Other structures of second embodiment are the same as first embodiment.

Third Embodiment

As shown from FIG. 9 to FIG. 12, the difference from the first embodiment is: there are 4 continuous varying cambered convex ridges evenly circumferentially distributed at the end face of the diamond layer, that is, the central angle between two adjacent continuous varying cambered convex ridges is 90°.

Fourth Embodiment

As shown from FIG. 13 to FIG. 16, the difference from the first embodiment is: there are 5 continuous varying cambered convex ridges evenly circumferentially distributed at the end face of the diamond layer, that is, the central angle between two adjacent continuous varying cambered convex ridges is 72°.

Fifth Embodiment

As shown from FIG. 17 to FIG. 20, the difference from the first embodiment is: the radial cross-section of the polycrystalline diamond compact is elliptical, and there are two continuous varying cambered convex ridges 503, 504, which are evenly circumferentially distributed at the end face of the polycrystalline diamond compact, extend along a major axis of the ellipse and intersect with each other at the center of the end face. The inclined angles of four flanks 505, 506, 507, 508 are equal. Each of transitional arc surfaces 509, 510 is disposed between flanks between continuous varying cambered convex ridges 503, 504, and the edge 511 of diamond layer may be set to be inclinedly chamfered. Alternatively, the radius of the convex ridge at the edge of the end face is 1 mm, and the radius of the convex ridge at the center of the end face is 6 mm.

Alternatively, the radial cross-section of the polycrystalline diamond compact is elliptical with the radius 12 mm of the major axis and the radius 7.94 mm of the minor axis.

Alternatively, the angle between flanks and the radial cross-section of the cemented carbide substrate 102 is 5~20°, such as 10°.

The diamond layer and cemented carbide substrate in the disclosure are sintered under ultra-high temperature and pressure, and then the end face of the diamond layer is machined to desired shape.

The disclosure also provides a drilling bit with the above-mentioned polycrystalline diamond compact disposed at its end face.

While the disclosure has been described with respect to a limited number of embodiments, those skilled in the art, having benefit of this disclosure, will appreciate that other embodiments may be devised which do not depart from the scope of the disclosure as disclosed herein. Accordingly, the scope of the disclosure should be limited only by the attached claims.

What is claimed is:

1. A polycrystalline diamond compact, comprising a cemented carbide substrate and a diamond layer disposed at a top face of the cemented carbide substrate, and there are at least two continuous varying cambered convex ridges at an end face of the diamond layer, each cambered convex ridge extending from an edge of the end face to the center of the end face, and a width of each cambered convex ridge increasing gradually from the edge of the end face to the center of the end face; and wherein a curvature radius of each continuous varying cambered convex ridge increases gradually from the edge of the end face to the center of the end face and is in proportion to a distance from the edge of the end face.

2. The polycrystalline diamond compact of claim 1, wherein a top face of the continuous varying cambered convex ridge is parallel to a bottom face of the cemented carbide substrate.

3. The polycrystalline diamond compact of claim 1, wherein two flanks tilting downwards are disposed at both sides of the continuous varying cambered convex ridge.

4. The polycrystalline diamond compact of claim 3, wherein an arc transitional surface is disposed between two flanks, which are located between two adjacent continuous varying cambered convex ridges.

5. The polycrystalline diamond compact of claim 3, wherein the flanks are inclined planes and an angle between the inclined plane and a radial cross-section of the cemented carbide substrate is 5° to 20°.

6. The polycrystalline diamond compact of claim 5, wherein the flanks are inclined planes and the angle between the inclined plane and the radial cross-section of cemented carbide substrate is 10° or 15°.

7. The polycrystalline diamond compact as claimed in claim 1, wherein a number of the continuous varying cambered convex ridges is 2 to 10.

8. The polycrystalline diamond compact of claim 7, wherein the number of continuous varying cambered convex ridges is 2 to 4.

9. The polycrystalline diamond compact as claimed claim 1, wherein a curvature radius of the continuous varying cambered convex ridges at the edge of the end face is 0.5 mm to 4 mm.

10. The polycrystalline diamond compact of claim 9, wherein the curvature radius of the continuous varying cambered convex ridges at the edge of the end face is 1 mm.

11. The polycrystalline diamond compact as claimed in claim 1 wherein the curvature radius of the continuous varying cambered convex ridge at the center of the end face is 4 mm to 12 mm.

12. The polycrystalline diamond compact of claim 11, wherein the curvature radius of the continuous varying cambered convex ridge at the center of the end face is 6 mm.

13. The polycrystalline diamond compact as claimed in claim 1, wherein the continuous varying cambered convex ridges are evenly distributed circumferentially on the end face.

14. The polycrystalline diamond compact as claimed in claim 1, wherein a radial cross-section of the polycrystalline diamond compact is round or elliptical.

15. A drilling bit having the polycrystalline diamond compact as claimed in claim 1 disposed at the end thereof.

* * * * *